US008052276B2

(12) United States Patent
Kawabata

(10) Patent No.: US 8,052,276 B2
(45) Date of Patent: Nov. 8, 2011

(54) IMAGE FORMING APPARATUS AND BELT CONVEYING DEVICE

(75) Inventor: Kenichi Kawabata, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 1014 days.

(21) Appl. No.: 11/820,584

(22) Filed: Jun. 19, 2007

(65) Prior Publication Data

US 2008/0003023 A1 Jan. 3, 2008

(30) Foreign Application Priority Data

Jul. 3, 2006 (JP) ..... 2006-183888

(51) Int. Cl.
*B41J 2/01* (2006.01)
*B65H 5/22* (2006.01)
*B65H 43/04* (2006.01)

(52) U.S. Cl. ..... 347/104; 271/6; 271/198

(58) Field of Classification Search ..... 347/104, 347/153, 264
See application file for complete search history.

(56) References Cited

U.S. PATENT DOCUMENTS 4,442,439 A * 4/1984 Mizuno ..... 347/74
5,397,043 A * 3/1995 Blanding ..... 226/21
5,896,148 A 4/1999 Fukushima et al.
7,572,002 B2 8/2009 Nishida
2002/0085864 A1* 7/2002 Abe ..... 399/299
2006/0284363 A1* 12/2006 Matsumoto et al. ..... 271/10.11

FOREIGN PATENT DOCUMENTS

JP 5-8392 1/1993
JP 11-180581 7/1999
JP 2005-17367 1/2005
JP 2006-1180 1/2006
JP 2006-168318 6/2006

* cited by examiner

*Primary Examiner* — Matthew Luu
*Assistant Examiner* — Kendrick Liu
(74) *Attorney, Agent, or Firm* — Cooper & Dunham LLP

(57) ABSTRACT

An image forming apparatus includes an image forming member and a belt conveying device. The image forming member is configured to form an image on a sheet. The belt conveying device is configured to convey the sheet. The belt conveying device includes first and second rollers, a conveying belt, a platen guide, a support, and an adjuster. The conveying belt has an endless belt-like shape and is looped over at least the first and second rollers. The platen guide is provided between the first and second rollers in a sheet conveyance direction and is configured to guide the conveying belt in a manner that the conveying belt forms a flat plane surface. The support is configured to support at least one end of the second roller in an axial direction of the second roller. The adjuster is configured to adjust a position of the support.

17 Claims, 13 Drawing Sheets

IMAGE FORMING APPARATUS AND BELT CONVEYING DEVICE

TECHNICAL FIELD

The present specification describes an image forming apparatus and a belt conveying device, and more particularly an image forming apparatus and a belt conveying device for conveying a sheet.

DISCUSSION OF THE BACKGROUND

An image forming apparatus, such as a copying machine, a printer, a facsimile machine, a plotter, or a multifunction printer having copying, printing, scanning, and facsimile functions, can form an image on a recording medium (e.g., a sheet) by a liquid discharging method. For example, a recording head (e.g., a liquid discharging head) discharges a recording liquid (e.g. an ink drop) onto a conveyed sheet to form an image on the sheet. Alternatively, an image forming apparatus can form an image on a sheet by an electrophotographic method.

In the image forming apparatus using the liquid discharging method, the recording head is requested to discharge an ink drop onto a sheet with an increased precision so as to form a high-quality image. To cope with this request, the image forming apparatus includes a belt conveying device for conveying a sheet. In the belt conveying device, a surface of a conveying belt is uniformly charged by generating a direct or alternating current electric field. An electrostatic force on the conveying belt attracts a sheet. A constant gap is provided between the recording head and the sheet on the conveying belt. Feeding of the sheet is controlled to prevent the sheet from being skewed and levitated. Thus, the sheet does not hit the recording head and thereby is not jammed and stained. Alternatively, the conveying belt may attract a sheet by air.

The belt conveying device further includes a driving roller and a driven roller (e.g., a tension roller). The conveying belt has an endless belt shape and is looped over the driving roller and one or more driven rollers. The conveying belt rotates to convey a sheet.

When the conveying belt moves obliquely, the conveying belt may not stably convey a sheet. When the conveying belt is installed in an image forming apparatus using the liquid discharging method, ink drops discharged by the recording head may impact various positions on a sheet. As a result, the image forming apparatus may not stably form a high-quality image. To cope with this problem, a bead for regulating the conveying belt is provided on an inner circumferential surface of the conveying belt.

One example of a background image forming apparatus includes an engine unit including an image forming member (e.g., a recording head), a carriage, a scanning mechanism, and a belt conveying device. The recording head is mounted on the carriage and discharges an ink drop to form an image on a sheet. The scanning mechanism moves the carriage in a main scanning direction. The belt conveying device conveys a sheet in a sub-scanning direction. The engine unit is attachable to and detachable from the image forming apparatus. The belt conveying device includes a frame and a belt unit including a conveying belt, a driving roller, and a driven roller. The conveying belt has an endless belt shape and is looped over the driving roller and the driven roller. The frame supports the belt unit. Namely, when the belt unit is set on the frame, the belt unit is properly positioned in the engine unit.

However, when the frame is warped or deformed, the belt unit may not be properly positioned in the engine unit. For example, the driving roller and the driven roller are not positioned in parallel to each other. As a result, the conveying belt may move obliquely or may be mounted on the frame.

In the belt unit, one end of each of the driving roller and the driven roller in an axial direction of the driving roller and the driven roller may be supported by a common support. However, another end of each of the driving roller and the driven roller in the axial direction of the driving roller and the driven roller needs to be supported by another support, because the endless conveying belt may not be looped over the driving roller and the driven roller when one common support supports both ends of the driving roller and the driven roller in the axial direction of the driving roller and the driven roller. As a result, another end of each of the driving roller and the driven roller may easily deviate upward or downward relative to one end of each of the driving roller and the driven roller. Namely, the driving roller and the driven roller are not positioned in parallel to each other. Thus, the conveying belt may move obliquely or may be mounted on the frame.

BRIEF SUMMARY

In an aspect of this disclosure, there is provided a novel image forming apparatus that includes an image forming member and a belt conveying device. The image forming member is configured to form an image on a sheet. The belt conveying device is configured to convey the sheet. The belt conveying device includes first and second rollers, a conveying belt, a platen guide, a support, and an adjuster. The conveying belt has an endless belt-like shape and is looped over at least the first and second rollers. The platen guide is provided between the first and second rollers in a sheet conveyance direction and is configured to guide the conveying belt in a manner that the conveying belt forms a flat plane surface. The support is configured to support at least one end of the second roller in an axial direction of the second roller. The adjuster is configured to adjust a position of the support.

In another aspect of this disclosure, there is provided a novel belt conveying device that includes first and second rollers, a conveying belt, a platen guide, a support, and an adjuster. The conveying belt has an endless belt-like shape and is looped over at least the first and second rollers. The platen guide is provided between the first and second rollers in a sheet conveyance direction and is configured to guide the conveying belt in a manner that the conveying belt forms a flat plane surface. The support is configured to support at least one end of the second roller in an axial direction of the second roller. The adjuster is configured to adjust a position of the support.

BRIEF DESCRIPTION OF THE DRAWINGS

The aforementioned and other aspects, features and advantages will be readily obtained as the same becomes better understood by reference to the following detailed description when considered in connection with the accompanying drawings, wherein.

DETAILED DESCRIPTION OF EXEMPLARY EMBODIMENTS

Figure 1:
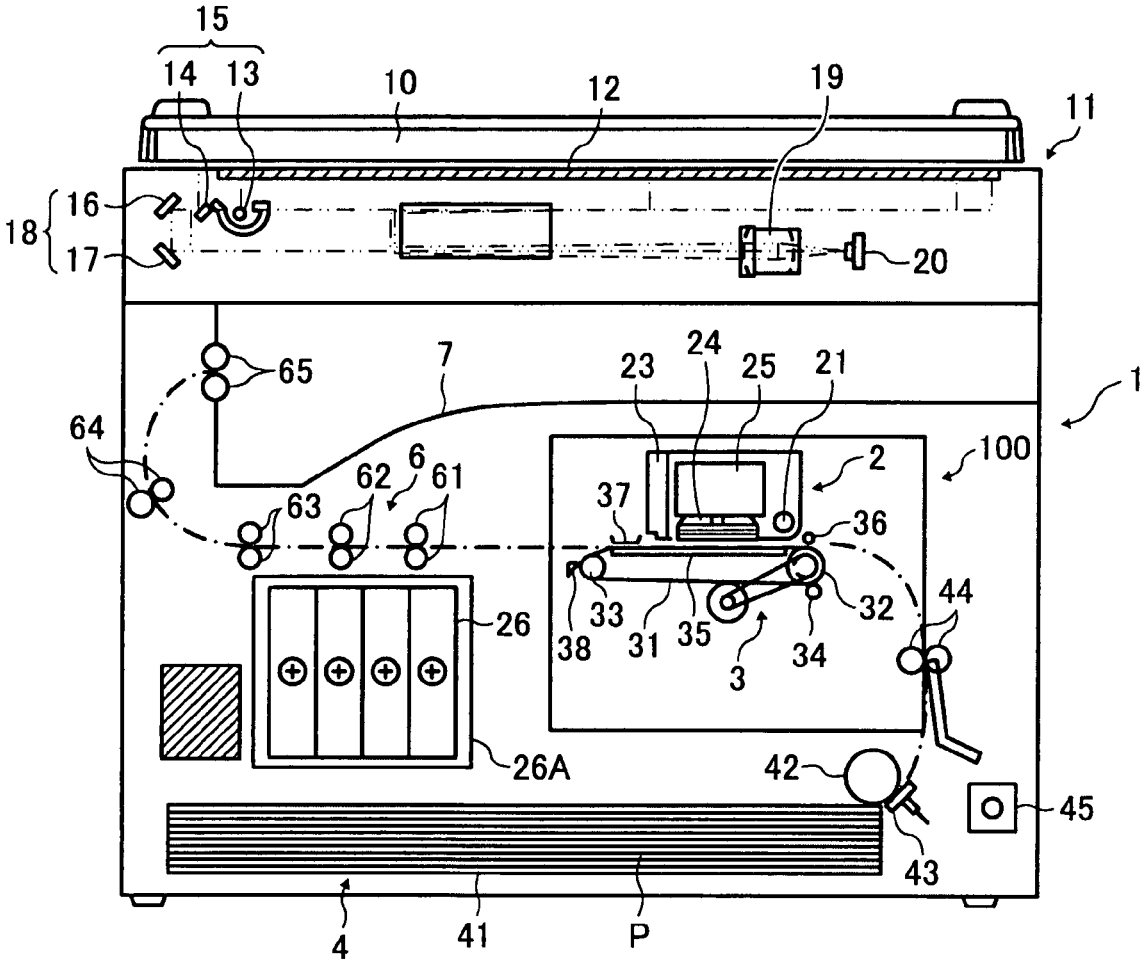
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment is explained.

FIG. 1 is a schematic view of the image forming apparatus 1. As illustrated in FIG. 1, the image forming apparatus 1 includes an exposure glass cover 10, a reader 11, an engine unit 100, ink cartridges 26, a cartridge holder 26A, a paper tray unit 4, an output conveyer 6, and an output tray 7. The engine unit 100 includes an image forming device 2 and a sub-scanning direction conveyer 3.

The image forming apparatus 1 can be included in any of a copying machine, a printer, a facsimile machine, and a multifunction printer including copying, printing, scanning, and facsimile functions. In this non-limiting exemplary embodiment, the image forming apparatus 1 functions as a color copying machine for forming a color image on a recording medium.

The exposure glass cover 10 is provided on the reader 11 and presses an original placed on the reader 11. The reader 11 (e.g., a scanner) is disposed in an upper portion of the image forming apparatus 1 and above the output tray 7, and scans an image on the original to generate image data (e.g., print data). The engine unit 100 has a structure unitizing the image forming device 2 with the sub-scanning direction conveyer 3, and is attachable to and detachable from a front of the image forming apparatus 1. The image forming device 2 forms an image on a recording medium according to the image data generated by the reader 11. The paper tray unit 4 loads a recording medium (e.g., a plurality of sheets P), which is not limited to paper. The paper tray unit 4 is disposed in a bottom portion of the image forming apparatus 1. The paper tray unit 4 separates an uppermost sheet P from the other sheets P to feed the sheets P one by one toward the sub-scanning direction conveyer 3. The sub-scanning direction conveyer 3 turns a direction in which a sheet P fed from the paper tray unit 4 is conveyed by about 90 degrees so that the sheet P opposes the image forming device 2, and conveys the sheet P towards the output conveyer 6. For example, the image forming device 2 discharges a recording liquid (e.g., an ink drop) onto a sheet P at an opposing position at which the image forming device 2 opposes the sub-scanning direction conveyer 3, while the sheet P is intermittently conveyed by the sub-scanning direction conveyer 3. The output conveyer 6 conveys the sheet P towards the output tray 7. The output tray 7 is disposed in the upper portion of the image forming apparatus 1 and receives the sheet P conveyed by the output conveyer 6.

The reader 11 includes an exposure glass 12, optical scanning systems 15 and 18, a lens 19, and a scanning element 20. The optical scanning system 15 includes a light source 13 and a mirror 14. The optical scanning system 18 includes mirrors 16 and 17.

An original having an image thereon is placed on the exposure glass 12 facing down. The exposure glass cover 10 is provided on the exposure glass 12 and presses the original towards the exposure glass 12. The optical scanning systems 15 and 18 move to scan an image on the original. The light source 13 irradiates light onto the original placed on the exposure glass 12. The mirror 14 deflects the light reflected by the original towards the mirror 16. The mirror 16 further deflects the light deflected by the mirror 14 towards the mirror 17. The mirror 17 further deflects the light deflected by the mirror 16 towards the lens 19. The lens 19 irradiates the light deflected by the mirror 17 towards the scanning element 20. The scanning element 20 converts the light into an image signal. The image signal is digitized and processed to generate image data.

The image forming device 2 includes a carriage guide 21, a carriage 23, recording heads 24, and sub tanks 25. The carriage guide 21 supports the carriage 23 together with a stay (not shown) in a state that the carriage 23 is movable in a main scanning direction. The carriage 23 carries the recording heads 24. The recording heads 24 discharge ink drops onto a sheet P sent from the paper tray unit 4 according to the image data generated by the reader 11. The sub tanks 25 are mounted on the carriage 23 and contain ink to be supplied to the recording heads 24.

The ink cartridges 26 contain black, cyan, magenta, and yellow inks, respectively, and are attachable to and detachable from the cartridge holder 26A disposed on the front of the image forming apparatus 1. The black, cyan, magenta, and yellow inks contained in the ink cartridges 26 are supplied to the sub tanks 25 via tubes (not shown), respectively. The black ink is supplied from one ink cartridge 26 to two sub tanks 25.

The paper tray unit 4 includes a paper tray 41, a feeding roller 42, a friction pad 43, a registration roller pair 44, and a feeding motor 45. The paper tray 41 loads a plurality of sheets P, and is attachable to and detachable from the image forming apparatus 1. The feeding roller 42 and the friction pad 43 feed the sheets P from the paper tray 41 one by one toward the registration roller pair 44. The registration roller pair 44 feeds the sheet P fed by the feeding roller 42 towards the sub-scanning direction conveyer 3. The feeding motor 45 includes an HB (hybrid) type stepping motor and serves as a driver for rotatably driving the feeding roller 42 and the registration roller pair 44 via a feeding clutch (not shown).

The sub-scanning direction conveyer 3 includes a conveying belt 31, a conveying roller 32, a tension roller 33, a charging roller 34, a platen guide 35, pressing rollers 36, a pressing member 37, and a separating nail 38.

The conveying belt 31 is formed in an endless belt-like shape and is looped over the conveying roller 32 and the tension roller 33. The conveying roller 32 (i.e., a first roller) serves as a driving roller for rotatably driving the conveying belt 31. The tension roller 33 (i.e., a second roller) serves as a driven roller for being rotatably driven by the conveying roller 32 via the conveying belt 31, and applies tension to the conveying belt 31. The charging roller 34 applies an alternating voltage (e.g., an alternating current bias voltage) to the conveying belt 31 to charge a surface of the conveying belt 31. The platen guide 35 opposes the image forming device 2 and guides the rotating conveying belt 31. The pressing rollers 36 oppose the conveying roller 32 via the conveying belt 31 and press the sheet P conveyed on the conveying belt 31 towards the conveying belt 31. The pressing member 37 presses the sheet P bearing an image formed by the image forming device 2 and conveyed on the conveying belt 31 towards the conveying belt 31. The separating nail 38 separates the sheet P bearing the image from the conveying belt 31.

The output conveyer 6 includes conveying roller pairs 61, 62, 63, and 64 and an output roller pair 65. The conveying roller pairs 61, 62, 63, and 64 feed the sheet P bearing the image and sent from the engine unit 100 towards the output roller pair 65. The output roller pair 65 feeds the sheet P bearing the image onto the output tray 7.

Figure 2:
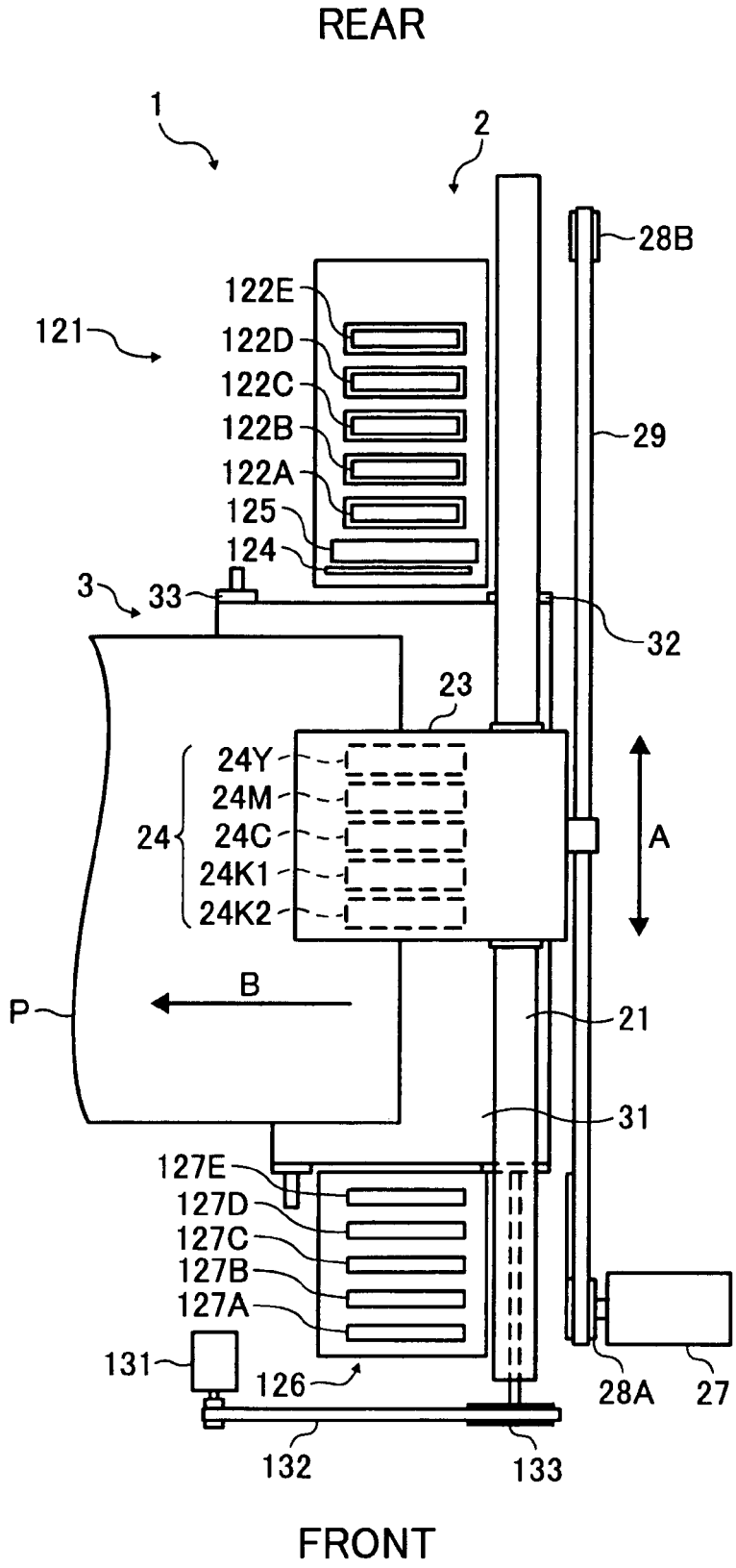
FIG. 2 is a top view of an image forming device and a sub-scanning direction conveyer of the image forming apparatus shown in FIG. 1.

FIG. 2 is a top view of the image forming device 2 and the sub-scanning direction conveyer 3. As illustrated in FIG. 2, the image forming device 2 further includes a timing belt 29, a driving pulley 28A, a driven pulley 28B, a main scanning motor 27, a maintenance-recovery mechanism 121, and an idle discharge receiver 126. The sub-scanning direction conveyer 3 further includes a sub-scanning motor 131, a timing belt 132, and a timing roller 133. The recording heads 24 include liquid drop discharging heads 24K2, 24K1, 24C, 24M, and 24Y. The maintenance-recovery mechanism 121 includes caps 122A, 122B, 122C, 122D, and 122E, a wiper blade 124, and an idle discharge receiver 125. The idle discharge receiver 126 includes openings 127A, 127B, 127C, 127D, and 127E.

The timing belt 29 is looped over the driving pulley 28A and the driven pulley 28B. The main scanning motor 27 rotates the driving pulley 28A. The rotating driving pulley 28A rotates the timing belt 29. The rotating timing belt 29 rotates the driven pulley 28B. The carriage 23 is attached to the timing belt 29. Thus, the main scanning motor 27 moves the carriage 23 via the driving pulley 28A, the driven pulley 28B, and the timing belt 29. Namely, the rotating timing belt 29 moves the carriage 23 supported by the carriage guide 21 and a stay (not shown) in a main scanning direction (i.e., directions A).

The recording heads 24 are mounted on the carriage 23 and discharge ink drops in a shuttle method. For example, while a sheet P is conveyed on the conveying belt 31 in a sub-scanning direction (i.e., a direction B), the recording heads 24 mounted on the carriage 23 and moving in the directions A discharge ink drops onto the sheet P.

The liquid drop discharging heads 24K2 and 24K1 discharge black ink. The liquid drop discharging heads 24C, 24M, and 24Y discharge cyan, magenta, and yellow inks, respectively. The black, cyan, magenta, and yellow inks are supplied from the sub tanks 25 (depicted in FIG. 1) mounted on the carriage 23, respectively.

Multiple types of the recording heads 24 including piezo, thermal, and electrostatic types may be used. The piezo type recording head uses a piezoelectric element as a pressure generator (e.g., an actuator) for applying pressure on ink in an ink flow route (e.g., a pressure generating room) to deform a vibration board forming walls of the ink flow route, so that a changed volume of the ink flow route discharges an ink drop. The thermal type recording head uses a heat generating resistance body to generate a bubble by boiling ink in an ink flow route, so that pressure of the bubble discharges an ink drop. The electrostatic type recording head uses a vibration board forming walls of an ink flow route and an electrode, which oppose each other, so that the vibration board deformed by an electrostatic force generated between the vibration board and the electrode changes a volume of the ink flow route and discharges an ink drop.

The maintenance-recovery mechanism 121 is disposed in a non-printing area near one end of the carriage guide 21 in the main scanning direction, and maintains and recovers conditions of nozzles of the recording heads 24. The five caps 122A, 122B, 122C, 122D, and 122E cap nozzles of the five recording heads 24K2, 24K1, 24C, 24M, and 24Y, respectively. The wiper blade 124 wipes the nozzles of the recording heads 24. The idle discharge receiver 125 receives an ink drop which is discharged during idle discharge and is not used for printing. The cap 122A is connected to a sucking pump (not shown) via a tube (not shown) so as to serve as a sucking and moisture-retaining cap. The caps 122B, 122C, 122D, and 122E serve as moisture-retaining caps.

The idle discharge receiver 126 is disposed in another non-printing area near the other end of the carriage guide 21 in the main scanning direction. The openings 127A, 127B, 127C, 127D, and 127E receive ink drops which are discharged from the recording heads 24 during idle discharge and are not used for printing. For example, the openings 127A, 127B, 127C, 127D, and 127E receive the ink drops discharged from the recording heads 24K2, 24K1, 24C, 24M, and 24Y, respectively.

The sub-scanning motor 131 rotates the timing belt 132. The rotating timing belt 132 rotates the timing roller 133. The rotating timing roller 133 rotates the conveying roller 32. The rotating conveying roller 32 rotates the conveying belt 31 in a sheet conveyance direction (i.e., the sub-scanning direction or the direction B).

An amount of rotation of the conveying roller 32 is detected so as to control driving of the sub-scanning motor 131 based on a detection result. An alternating current bias supplier (not shown) applies an alternating voltage (i.e., a square-wave, high voltage having positive and negative polarities) to the charging roller 34 (depicted in FIG. 1). Electric charges having positive and negative polarities are alternately applied to form strips in the sheet conveyance direction of the conveying belt 31. The conveying belt 31 is charged in a predetermined charging width to form an uneven electric field.

As illustrated in FIG. 1, a sheet P is fed from the paper tray unit 4 towards a nip formed between the conveying roller 32 and the pressing rollers 36 via the conveying belt 31. The pressing rollers 36 and the conveying roller 32 feed the sheet P onto the conveying belt 31 where electric charges having positive and negative polarities form an uneven electric field. The sheet P is instantly polarized in accordance with directions of the electric field. The conveying belt 31 electrostatically attracts and conveys the sheet P.

While the conveying belt 31 intermittently conveys the sheet P, the recording heads 24 discharge ink drops onto the sheet P to form an image on the sheet P. When the separating nail 38 touches a foremost head of the sheet P, the separating nail 38 separates the sheet P from the conveying belt 31 and the tension roller 33 feeds the sheet P via the conveying belt 31 towards the output conveyer 6.

As illustrated in FIG. 2, when the image forming device 2 is in a standby mode and thereby does not perform a print operation, the carriage 23 is moved to the maintenance-recovery mechanism 121 and the caps 122A, 122B, 122C, 122D and 122E cap the nozzles of the recording heads 24 to enable the nozzles to remain moist. Thus, ink in the nozzles is not dried, preventing a faulty discharge of ink. When the cap 122A caps the nozzles of the recording heads 24, ink is sucked from the nozzles to remove viscous ink and bubbles in a recovery operation. The wiper blade 124 wipes the nozzles of the recording heads 24 to remove ink adhered to the nozzles during the recovery operation. The recording heads 24 discharge ink not used for the print operation towards the idle discharge receiver 125 before and during the print operation. Thus, the recording heads 24 may maintain a stable discharging performance.

Figure 3:
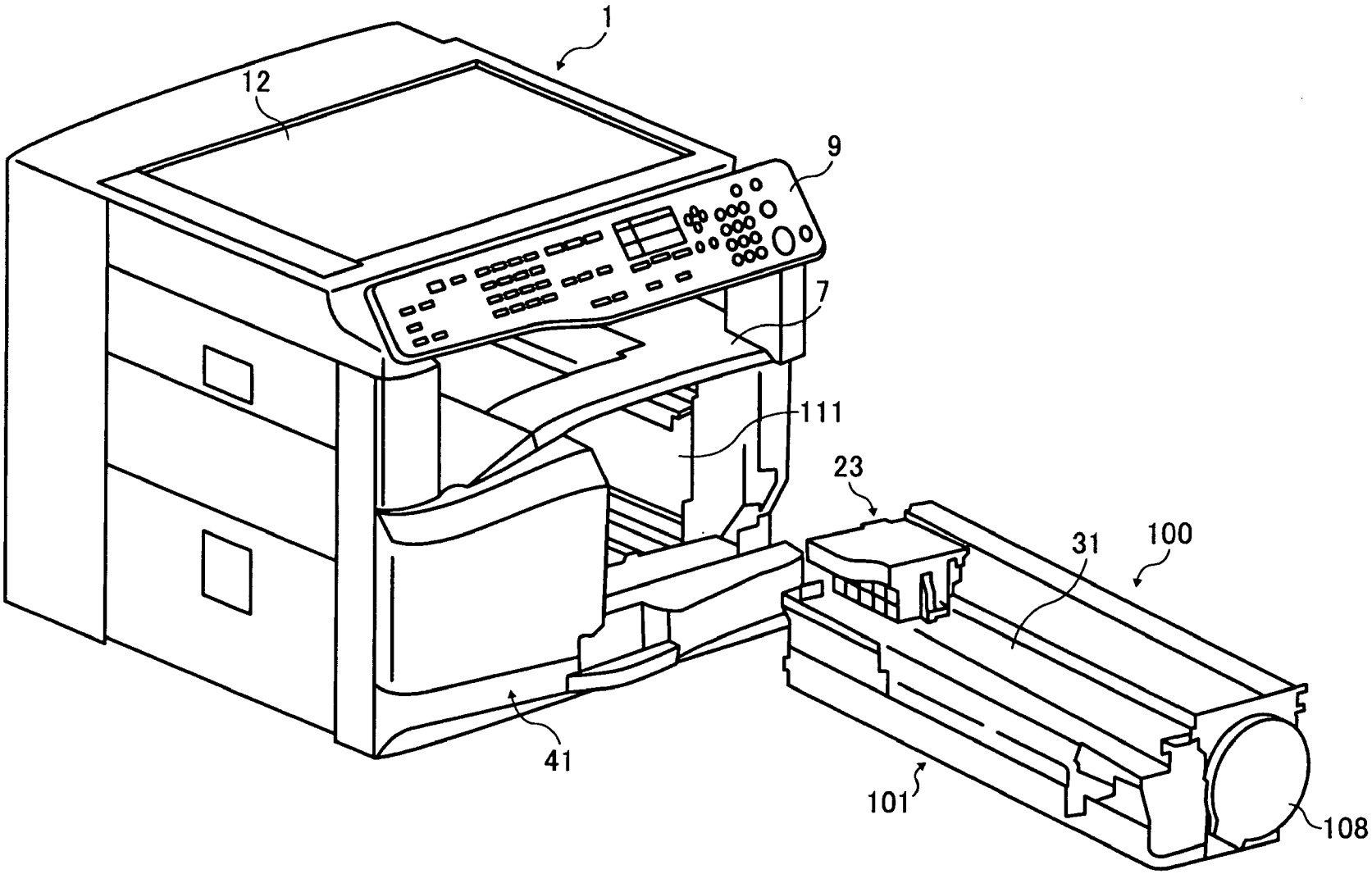
FIG. 3 is a perspective view of the image forming apparatus shown in FIG. 1.

Referring to FIGS. 3 to 7, the following describes a support mechanism for supporting the engine unit 100. FIG. 3 is a perspective view of the image forming apparatus 1 when the engine unit 100 is detached from the image forming apparatus 1. As illustrated in FIG. 3, the image forming apparatus 1 further includes a control panel 9 and a cabinet 111. The engine unit 100 further includes a belt cover 108 and a frame 101.

The control panel 9 is disposed in an upper front portion of the image forming apparatus 1. A user operates the control panel 9 to input commands for printing. The cabinet 111 is provided under the output tray 7 and holds the engine unit 100. The belt cover 108 covers the timing belt 132 (depicted in FIG. 2) and is disposed in a front of the engine unit 100 (i.e., the front of the image forming apparatus 1) when the engine unit 100 is attached to the image forming apparatus 1. The frame 101 supports or holds the image forming device 2 (depicted in FIG. 1) and the sub-scanning direction conveyer 3 (depicted in FIG. 1).

Figure 4:
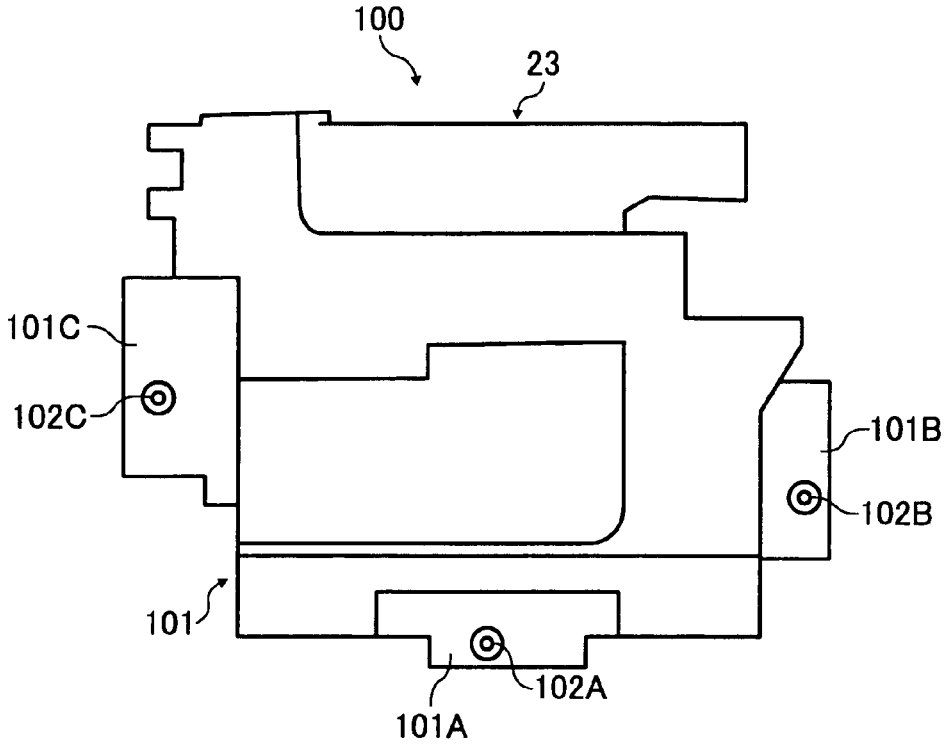
FIG. 4 is a rear view of an engine unit of the image forming apparatus shown in FIG. 1.
Figure 5:
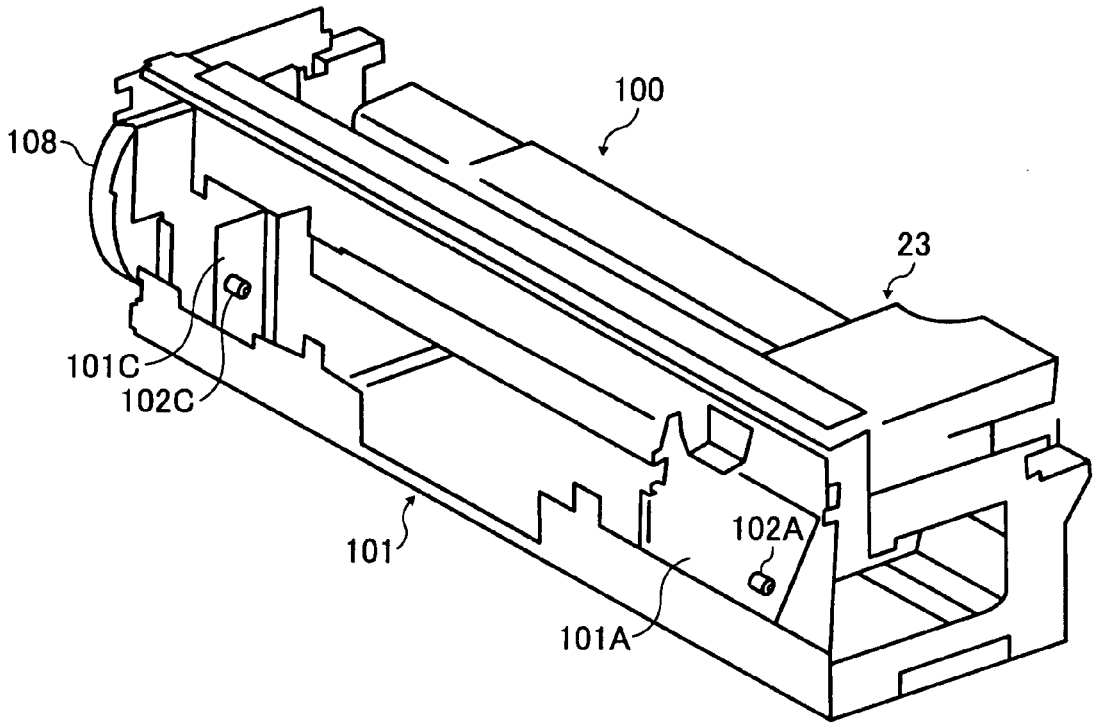
FIG. 5 is a perspective view of the engine unit shown in FIG. 4, illustrating an upstream side of the engine unit in a sheet conveyance direction.
Figure 6:
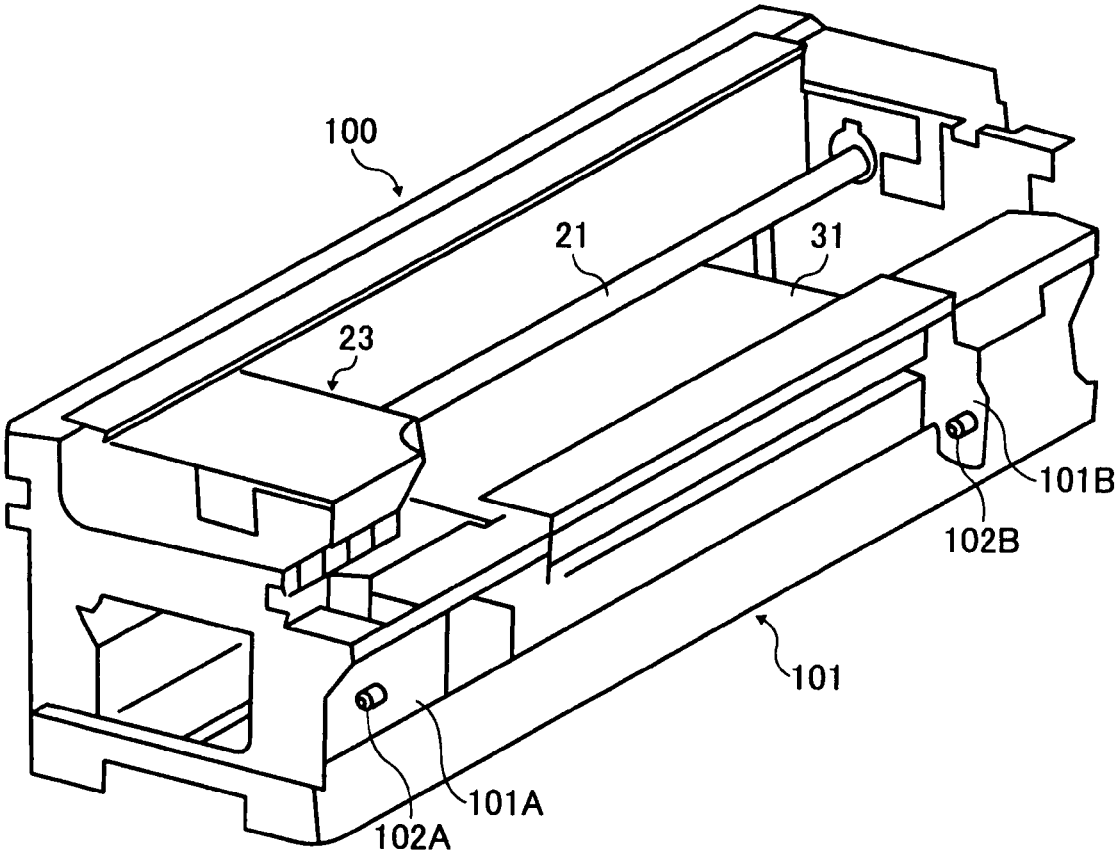
FIG. 6 is a perspective view of the engine unit shown in FIG. 4, illustrating a downstream side of the engine unit in the sheet conveyance direction.

FIG. 4 is a rear view of the engine unit 100. FIG. 5 is a perspective view of the engine unit 100 illustrating an upstream side of the engine unit 100 in the sheet conveyance direction. FIG. 6 is a perspective view of the engine unit 100 illustrating a downstream side of the engine unit 100 in the sheet conveyance direction. As illustrated in FIGS. 4 to 6, the frame 101 includes a support pin 102A and a frame plate 101A. As illustrated in FIGS. 4 and 6, the frame 101 further includes a support pin 102B and a frame plate 101B. As illustrated in FIGS. 4 and 5, the frame 101 further includes a support pin 102C and a frame plate 101C. The support pins 102A, 102B, and 102C support the engine unit 100 with respect to the image forming apparatus 1. The support pins 102A, 102B, and 102C are crimped to the frame plates 101A, 101B, and 101C, respectively. The support pin 102A and the frame plate 101A are provided in a bottom portion of the frame 101. The support pin 102B and the frame plate 101B are provided in a downstream portion of the frame 101 in the sheet conveyance direction. The support pin 102C and the frame plate 101C are provided in an upstream portion of the frame 101 in the sheet conveyance direction. The support pins 102A, 102B, and 102C support the engine unit 100 at first, second, and third support points, respectively.

Figure 7:
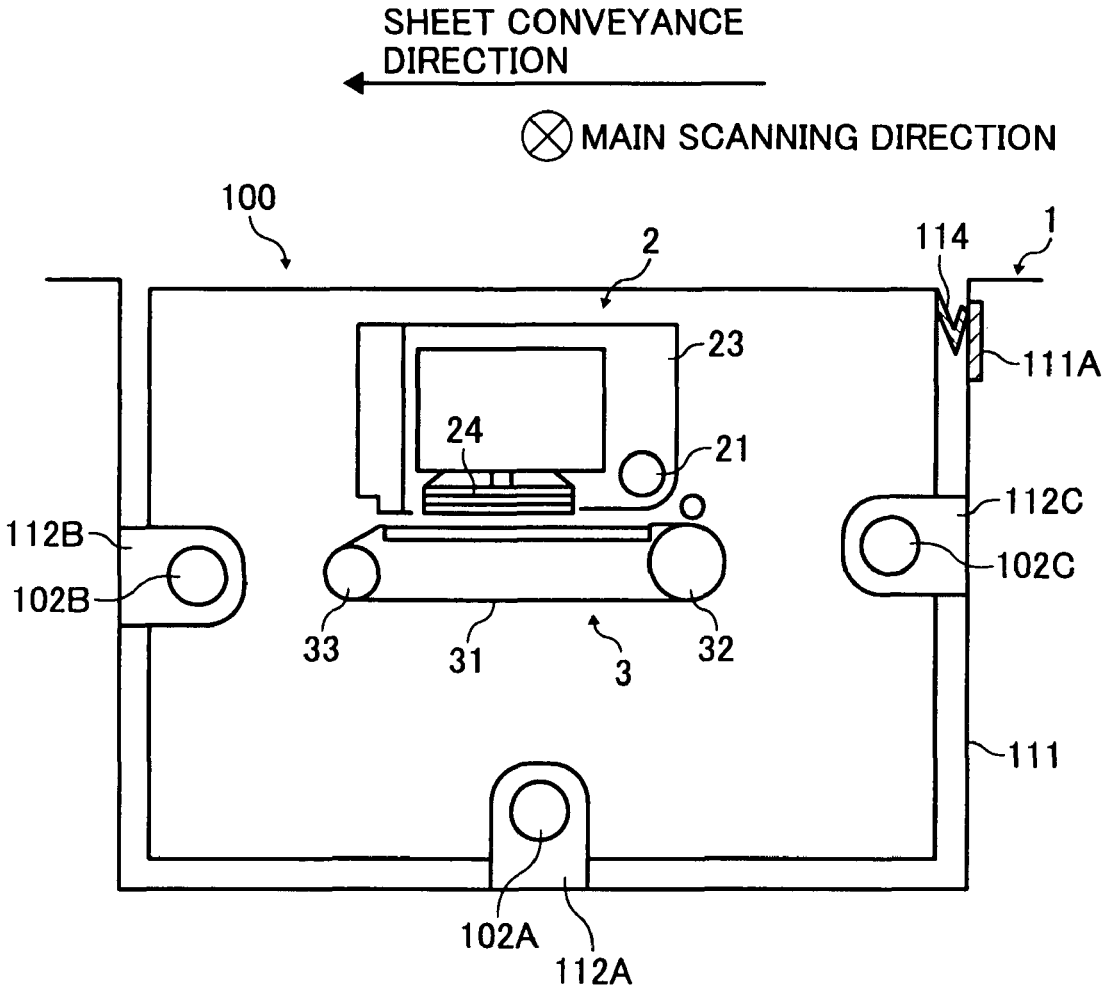
FIG. 7 is a front view of an engine unit and a cabinet of the image forming apparatus shown in FIG. 1.

FIG. 7 is a front view of the engine unit 100 and the cabinet 111. As illustrated in FIG. 7, the image forming apparatus 1 further includes a vibration damper 114. The cabinet 111 includes holders 112A, 112B, and 112C and a damp portion 111A. When the engine unit 100 is inserted in the cabinet 111, the support pins 102A, 102B, and 102C engage with the holders 112A, 112B, and 112C, respectively. The support pins 102A, 102B, and 102C protrude toward a rear of the image forming apparatus 1, as illustrated in FIGS. 5 and 6, in a direction in which the engine unit 100 is inserted into the cabinet 111.

As illustrated in FIG. 7, when the engine unit 100 is attached to the image forming apparatus 1 (i.e., when the engine unit 100 is inserted in the cabinet 111), the holders 112A, 112B, and 112C included in the cabinet 111 engage with the support pins 102A, 102B, and 102C included in the engine unit 100, respectively, to support the engine unit 100. Thus, the engine unit 100 is supported at three points in the cabinet 111. The support pins 102A, 102B, and 102C included in the engine unit 100 are rotatably held by the holders 112A, 112B, and 112C included in the cabinet 111, respectively. The support pins 102A, 102B, and 102C are also held in a manner that the support pins 102A, 102B, and 102C are movable in the main scanning direction.

As described above, the engine unit 100 is supported at three points. Therefore, a stress, which may be applied to the engine unit 100 when the frame 101 (depicted in FIG. 3) included in the engine unit 100 is fixed to the cabinet 111, is not applied to the engine unit 100. Thus, the engine unit 100 is not warped or deformed. Namely, the engine unit 100 may be attached to the image forming apparatus 1 in a state that the image forming device 2 and the sub-scanning direction conveyer 3 are properly positioned in the engine unit 100.

Accordingly, as illustrated in FIG. 2, the conveying belt 31 is not warped or distorted and thereby a gap between the recording heads 24 and a sheet P conveyed on the conveying belt 31 is not changed. Positions of the carriage guide 21 and the conveying belt 31 provided parallel to each other are not changed. An impact position on a sheet P at which an ink drop discharged by the recording heads 24 impacts the sheet P does not vary. Further, faulty sliding of the carriage 23 is prevented. Thus, the engine unit 100 (depicted in FIG. 7), having a structure unitizing the image forming device 2 with the sub-scanning direction conveyer 3, may improve a maintenance operation and may prevent formation of an image having a decreased image quality.

Instead of supporting the engine unit 100 at three points as illustrated in FIG. 7, the frame 101 (depicted in FIG. 4) included in the engine unit 100 may be fixed to the cabinet 111 with an engaging member (e.g., a screw). In this case, the frame 101 may be solidly fixed to the cabinet 111. Even when the carriage 23 moves in the main scanning direction or the conveying belt 31 is intermittently driven to convey a sheet P, the engine unit 100 may not vibrate or swing.

When the frame 101 is fixed to the cabinet 111 with an engaging member, a subtle stress may be applied to the frame 101 due to deviation in positioning the frame 101 in the cabinet 111. For example, the frame 101 is attached to the cabinet 111 in a state that the frame 101 is distorted in different directions at both ends of the frame 101 in the main scanning direction. When the frame 101 is distorted or warped, the distorted or warped frame 101 may affect the conveying belt 31 or the carriage guide 21. As a result, the recording heads 24 may discharge ink drops onto a sheet P at improper positions, forming an image having a decreased image quality. Namely, an image having an improved image quality may not be formed although a maintenance operation is improved.

On the contrary, when the engine unit 100 is supported at three points in the image forming apparatus 1 as illustrated in FIG. 7, the frame 101 may not be distorted or warped.

When the carriage 23 moves in the main scanning direction or the conveying belt 31 intermittently feeds a sheet P in the sub-scanning direction, the movable frame 101 may vibrate the engine unit 100. The vibration of the engine unit 100 may be transmitted to the cabinet 111 and may generate noise.

As illustrated in FIG. 7, the damp portion 111A is provided on a part of the cabinet 111. The vibration damper 114 is provided between the frame 101 (depicted in FIG. 3) and the cabinet 111. The vibration damper 114 is fixed to the cabinet 111 and applies a pressure to the frame 101 in the sheet conveyance direction. According to this exemplary embodiment, a plate spring is used as the vibration damper 114. However, the vibration damper 114 may include an elastic member (e.g., a coil spring, a sponge, a rubber, and/or the like) and a mechanical shock absorber (e.g., an oil damper and/or the like).

The engine unit 100 is rotatably supported by the support pin 102A provided in the bottom portion of the frame 101. The vibration damper 114 presses the engine unit 100 in the sheet conveyance direction. Thus, even when the carriage 23 moves in the main scanning direction or the conveying belt 31 intermittently feeds a sheet P in the sub-scanning direction, the engine unit 100 may not vibrate. Namely, the image forming apparatus 1 may not vibrate, reducing noise.

Figure 8:
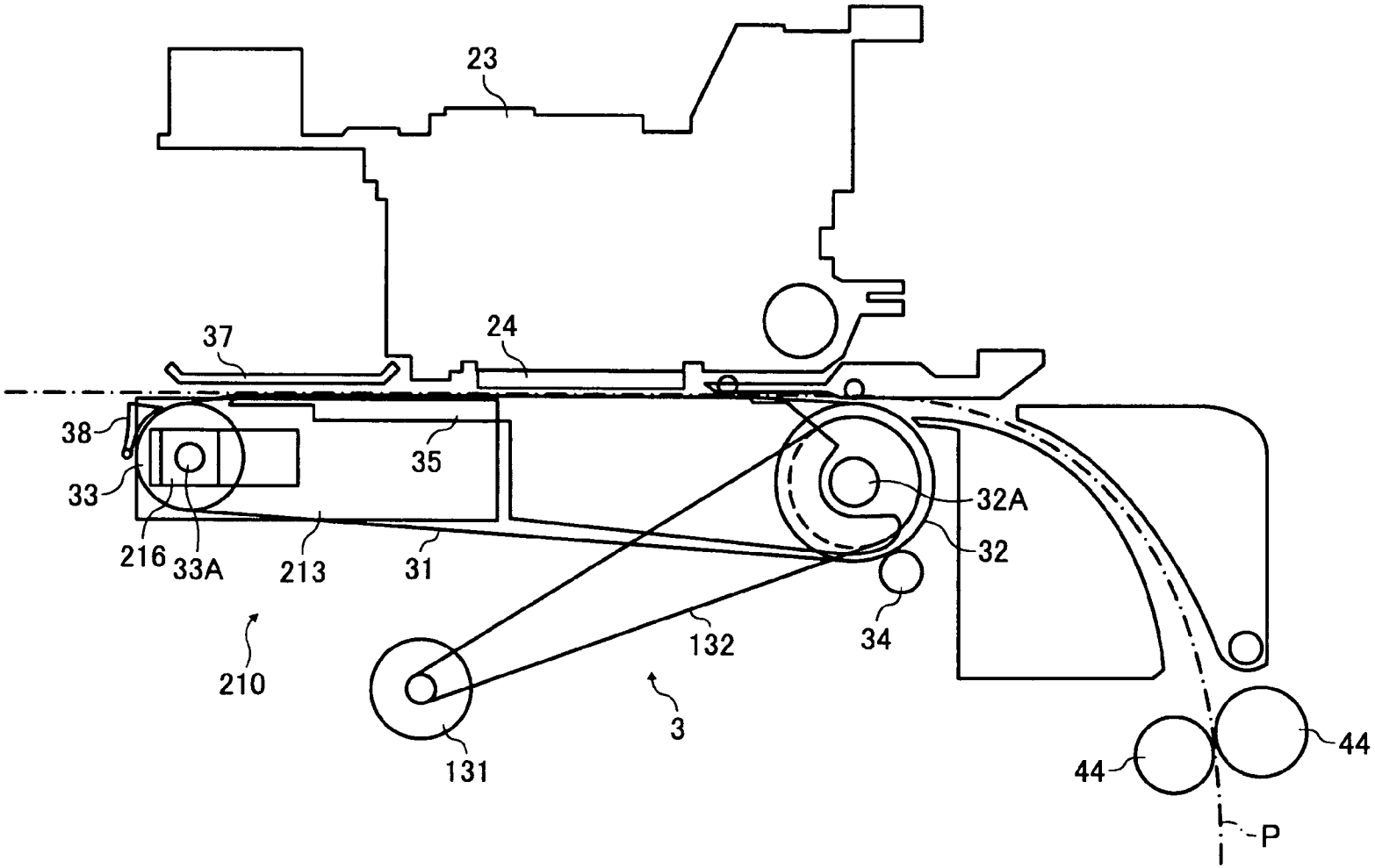
FIG. 8 is an enlarged view of the sub-scanning direction conveyer shown in FIG. 2.

Referring to FIGS. 8 to 11, the following describes a belt unit 210 included in the sub-scanning direction conveyer 3 and configured to convey a sheet P in the sub-scanning direction. FIG. 8 is an enlarged view of the sub-scanning direction conveyer 3. As illustrated in FIG. 8, the sub-scanning direction conveyer 3 includes the belt unit 210. The belt unit 210 includes the conveying belt 31, the conveying roller 32, the tension roller 33, the platen guide 35, shafts 32A and 33A, a bearing 216, and a support 213.

As described above, the conveying belt 31 having an endless belt shape is looped over the conveying roller 32 serving as a driving roller and the tension roller 33 serving as a driven roller. The platen guide 35 is provided between the conveying roller 32 and the tension roller 33 in the sheet conveyance direction and opposes the recording heads 24 serving as an image forming member for forming an image on a sheet P. The shafts 32A and 33A support the conveying roller 32 and the tension roller 33, respectively. The bearing 216 supports the shaft 33A. The support 213 supports the bearing 216.

Figure 9:
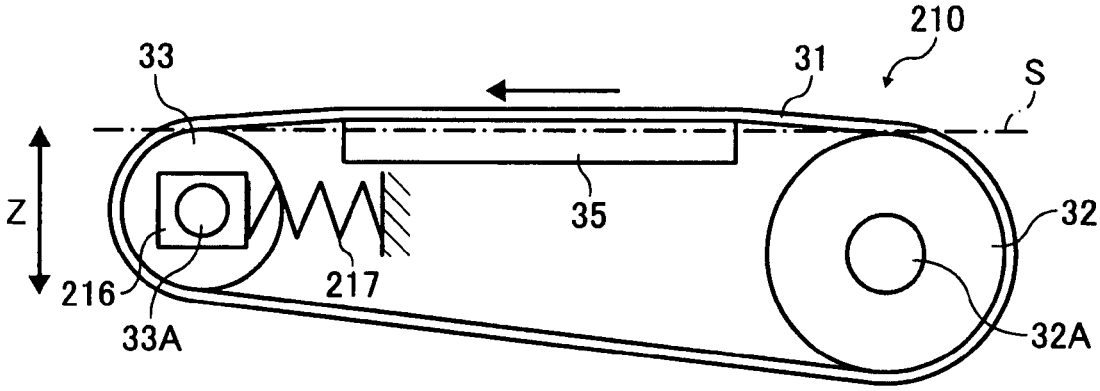
FIG. 9 is a front view of a belt unit of the sub-scanning direction conveyer shown in FIG. 8.

FIG. 9 is a front view of the belt unit 210. As illustrated in FIG. 9, the belt unit 210 further includes a spring 217. The spring 217 applies a tension to the bearing 216. The platen guide 35 pushes up the conveying belt 31 above a tangent line S formed between the conveying roller 32 and the tension roller 33 towards the recording heads 24 (depicted in FIG. 8), so that a portion of the conveying belt 31 (in contact with the platen guide 35) forms a flat plane surface. The belt unit 210 further includes a cleaner (not shown) for cleaning the surface of the conveying belt 31.

Figure 10:
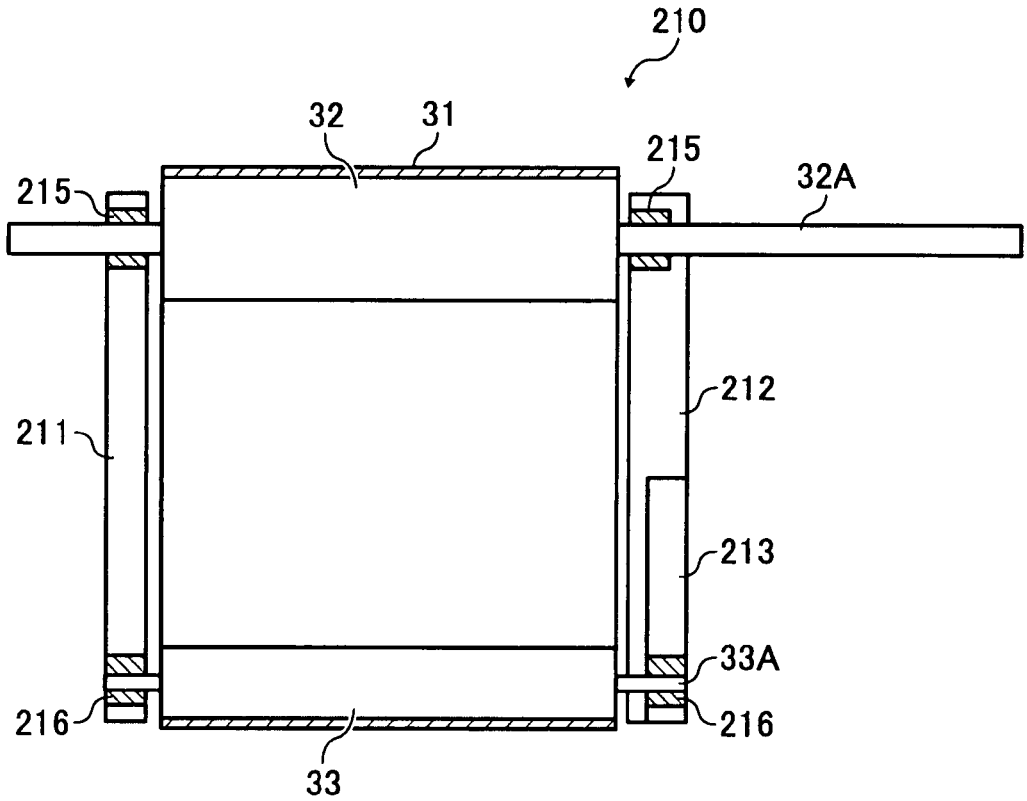
FIG. 10 is a top view of the belt unit shown in FIG. 9.

FIG. 10 is a top view of the belt unit 210. As illustrated in FIG. 10, the belt unit 210 further includes a bearing 215, and supports 211 and 212. The bearing 215 supports the shaft 32A. The supports 211 and 212 support the bearings 215 and 216. Namely, the support 211 supports one end of the shafts 32A and 33A in the main scanning direction (i.e., an axial direction of the conveying roller 32 and the tension roller 33) via the bearings 215 and 216, respectively. The support 212 supports another end of the shaft 32A in the main scanning direction (i.e., the axial direction of the conveying roller 32) via the bearing 215. The support 213 attached to the support 212 supports another end of the shaft 33A in the main scanning direction (i.e., the axial direction of the tension roller 33) via the bearing 216.

Figure 11:
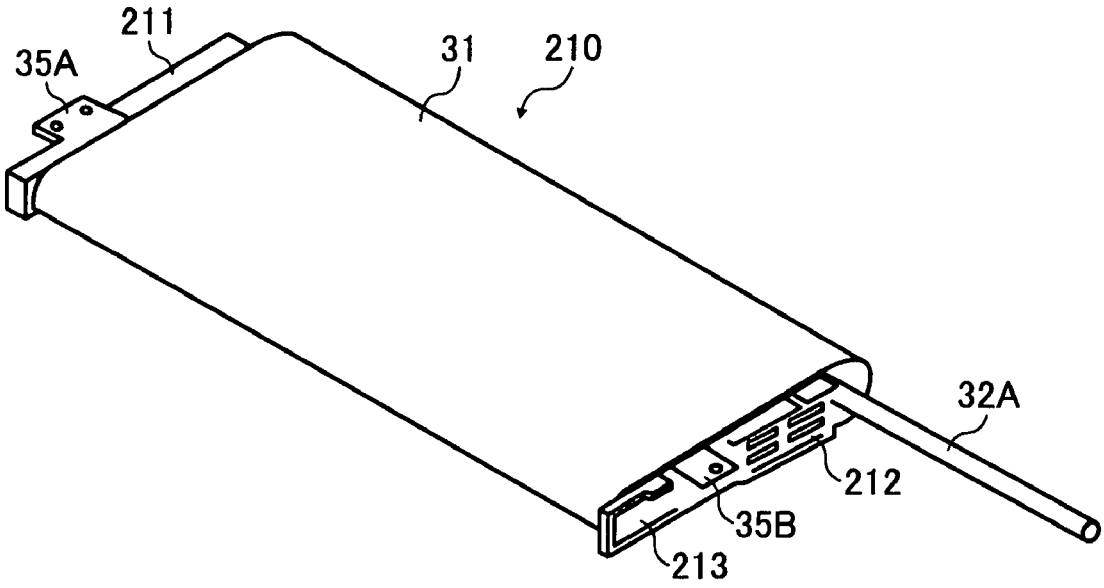
FIG. 11 is a perspective view of the belt unit shown in FIG. 9.

FIG. 11 is a perspective view of the belt unit 210. As illustrated in FIG. 11, the belt unit 210 further includes flanges 35A and 35B. The flange 35A is formed on one end of the platen guide 35 (depicted in FIG. 9) in the main scanning direction. The flange 35B is formed on another end of the platen guide 35 in the main scanning direction.

Figure 12:
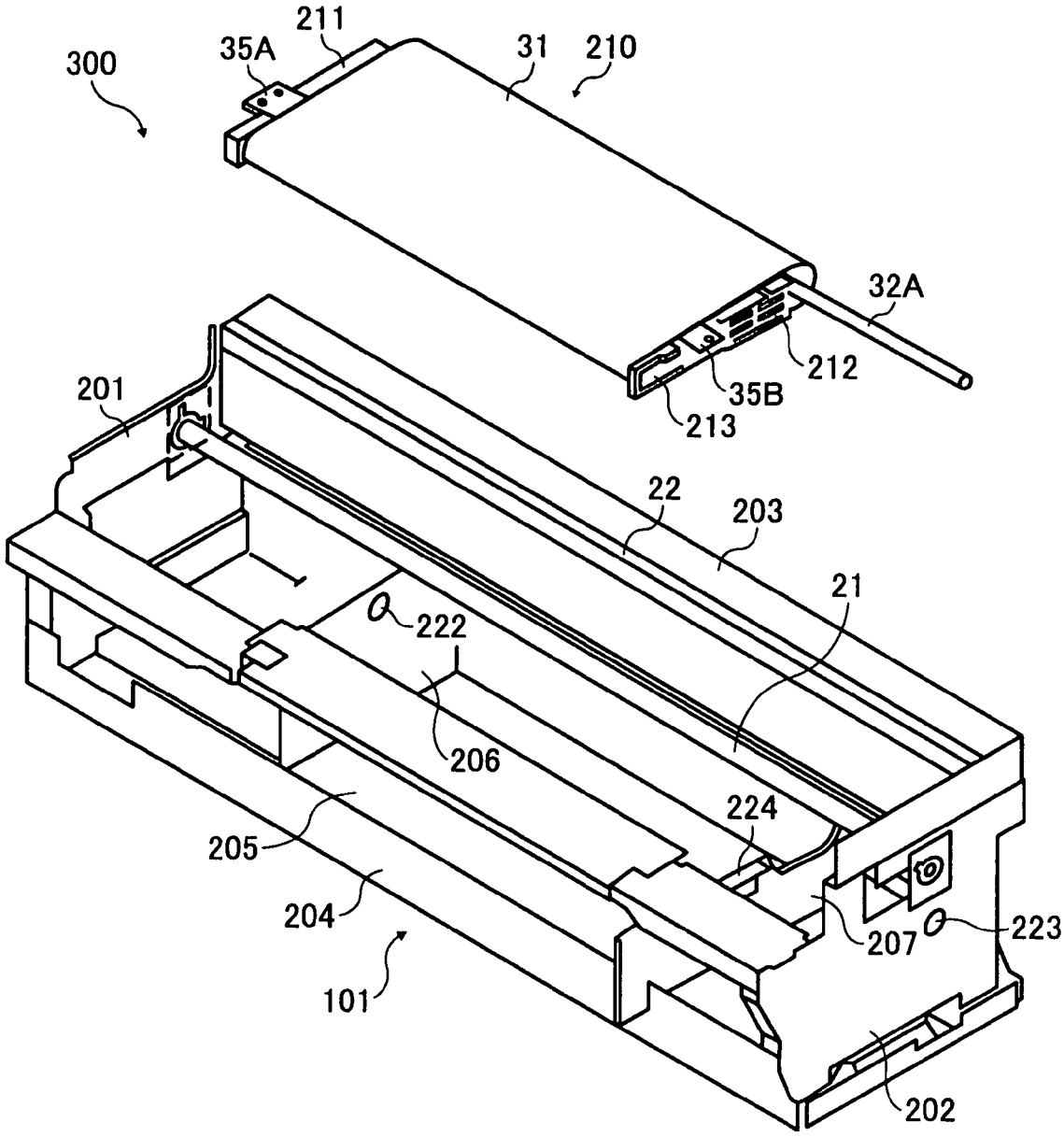
FIG. 12 is a perspective view of the belt unit shown in FIG. 11 and a frame of the engine unit shown in FIG. 4, before the belt unit is attached to the frame.
Figure 13:
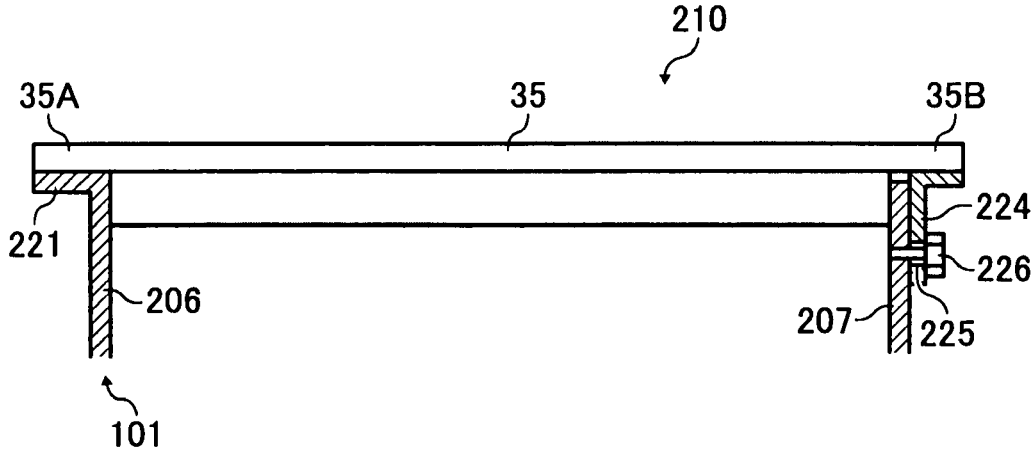
FIG. 13 is a sectional side view of the belt unit and the frame shown in FIG. 12.
Figure 14:
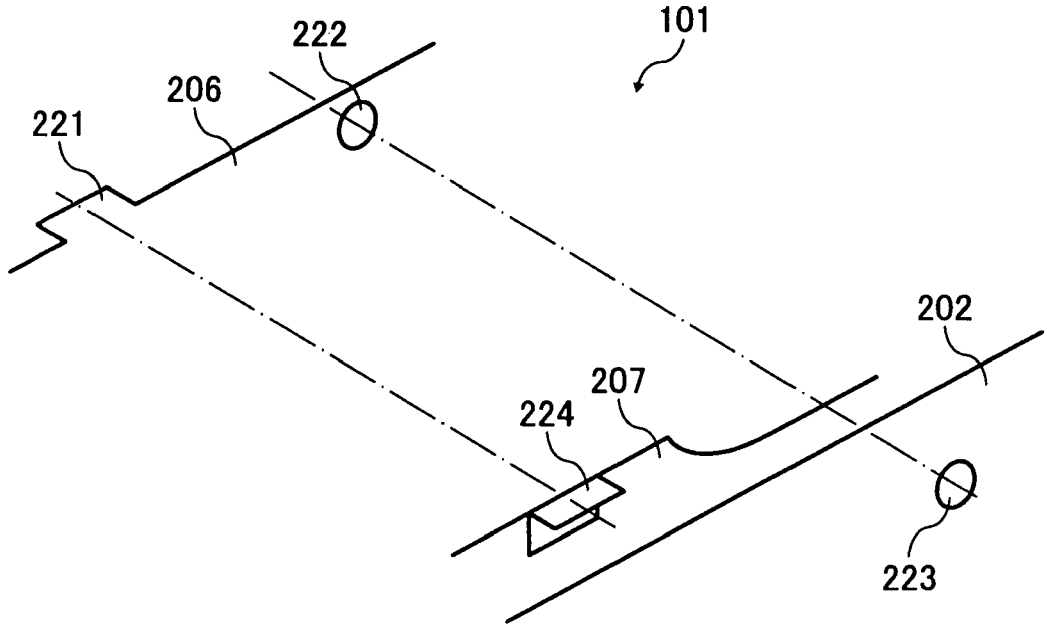
FIG. 14 is a perspective view of a portion of the frame shown in FIG. 12.

Referring to FIGS. 12 to 14, the following describes how to attach the belt unit 210 to the frame 101. FIG. 12 is a perspective view of the belt unit 210 and the frame 101 before the belt unit 210 is attached to the frame 101. The belt unit 210 and the frame 101 form a belt conveying device 300 for conveying a sheet P. As illustrated in FIG. 12, the frame 101 further includes side plates 201 and 202, a front plate 203, a back plate 204, a bottom plate 205, sub side plates 206 and 207, a guide rail 22, receivers 222 and 223, and an adjustment plate 224.

The side plates 201 and 202 are provided in rear and front portions of the frame 101, respectively. Namely, the side plates 201 and 202 are provided in both ends of the frame 101 in the main scanning direction, respectively. The front plate 203 and the back plate 204 are provided in an upstream portion and a downstream portion of the frame 101 in the sheet conveyance direction, respectively. The bottom plate 205 is provided in a bottom portion of the frame 101. The front plate 203, the back plate 204, and the bottom plate 205 are bridged between the side plates 201 and 202. The sub side plates 206 and 207 are provided between the side plates 201 and 202. The side plates 201 and 202, the front plate 203, the back plate 204, the bottom plate 205, and the sub side plates 206 and 207 are formed of a single or a plurality of plates. The sub side plate 206 includes the frame plate 101A (depicted in FIG. 4). The sub side plate 207 includes the frame plates 101B and 101C (depicted in FIG. 4).

The carriage guide 21, which guides the carriage 23 (depicted in FIG. 2) moving in the main scanning direction, is bridged between the side plates 201 and 202. The guide rail 22 is mounted on the front plate 203 and guides the carriage 23 moving in the main scanning direction. The belt unit 210 is installed between the sub side plates 206 and 207. One end of the shaft 32A in the main scanning direction is attached to the sub side plate 206 and another end of the shaft 32A in the main scanning direction is attached to the side plate 202.

The receivers 222 and 223 are provided on the sub side plate 206 and the side plate 202, respectively. Bearings (not shown) are fixed to the receivers 222 and 223, respectively, and rotatably support one end and another end of the shaft 32A in the main scanning direction, respectively. The adjustment plate 224 has an L-like shape, and is attached to the sub side plate 207 in a manner that the height (or vertical position) of the adjustment plate 224 is adjustable (discussed infra).

FIG. 13 is a sectional side view of the belt unit 210 and the frame 101. As illustrated in FIG. 13, the frame 101 further includes a support 221, an elongate hole 225, and an engaging member 226. The support 221 has an L-like shape, and is integrally molded with the sub side plate 206. Alternatively, the support 221 is separately molded from the sub side plate 206 and is fixed to the sub side plate 206. The flange 35A can be secured to the support 221 with a screw (not shown). The flange 35B can be secured to the adjustment plate 224 with another screw (not shown). The elongate hole 225 is formed in the adjustment plate 224 in a manner that the elongate hole 225 elongates in a horizontal direction, for example. The engaging member 226 (e.g., a screw) engages the adjustment plate 224 with the sub side plate 207 via the elongate hole 225.

Namely, the adjustment plate 224 is secured to the sub side plate 207 with the engaging member 226 in a manner that the height (or position along approximately the vertical direction) of the adjustment plate 224 is adjustable with respect to the sub side plate 207.

FIG. 14 is a perspective view of a portion of the frame 101. As illustrated in FIG. 14, the belt unit 210 (depicted in FIG. 12) is supported at four points (i.e., the receivers 222 and 223, the support 221, and the adjustment plate 224) in the frame 101. At one of the four points, the height (or vertical position) of the belt unit 210 may be adjusted by the adjustment plate 224. The sub side plates 206 and 207 and the side plate 202 support the belt unit 210 in a manner that the conveying belt 31 (depicted in FIG. 12) forms substantially a flat plane surface. Even when the conveying belt 31 is removed or replaced with a new one, the conveying belt 31 may be easily set in the image forming apparatus 1 (depicted in FIG. 1) in a manner that the conveying belt 31 forms substantially a flat plane surface.

If the belt unit 210 is supported at four points in a manner that the belt unit 210 is directly fixed to the sub side plates 206 and 207 and the side plate 202, the belt unit 210 may be distorted or warped, and as a result, the conveying belt 31 may not form a flat plane surface. In addition, if the sub side plate 206 or 207 or the side plate 202 becomes warped, the warping may directly affect the conveying belt 31. For example, even if the belt unit 210 is initially attached to the frame 101 with an assembly jig so that the conveying belt 31 forms a flat plane surface, the flat plane surface may not be easily reproduced once the belt unit 210 is detached from the frame 101.

On the other hand, when the belt unit 210 is supported at three points in a manner that the belt unit 210 is directly fixed to the sub side plates 206 and 207 and the side plate 202, the belt unit 210 generally will not be distorted or warped. After the belt unit 210 is fixed at three points to the sub side plate 206 and the side plate 202 in a manner that the conveying belt 31 forms a flat plane surface, the belt unit 210 is fixed at another point by adjusting the height (or vertical position) of the adjustment plate 224 to the position determined by the three points. The adjustment plate 224 may prevent the belt unit 210 from being distorted or warped. Even when the belt unit 210 is detached from the frame 101, the belt unit 210 may be properly attached to the frame 101 again in a manner that the conveying belt 31 forms a flat plane surface.

In addition, when a user removes the belt unit 210 from the frame 101 to replace the conveying belt 31 with new one, such a configuration of the conveying belt 31 and frame 101 enables the user to readily attach the belt unit 210 to the frame 101 in a proper manner so that the conveying belt 31 forms a flat plane surface without using an assembly jig, improving a maintenance operation.

As illustrated in FIG. 10, another end of the shaft 32A of the conveying roller 32 and the shaft 33A of the tension roller 33 are supported by separate elements (i.e., the supports 212 and 213). Moreover, the support 213 is attached to the support 212. As a result, a clearance is formed between the supports 212 and 213. As illustrated in FIG. 9, the spring 217 prevents a clearance from being formed in a direction in which the tension roller 33 moves away from the conveying roller 32. However, a clearance is formed in a direction perpendicular to the sheet conveyance direction of the conveying belt 31 (i.e., a direction Z).

To address this problem, the frame 101 (depicted in FIG. 12) further includes an adjuster for adjusting a position (or height) of the support 213 (depicted in FIG. 10) supporting the tension roller 33 via the bearing 216 and the shaft 33A in the direction Z.

Figure 15:
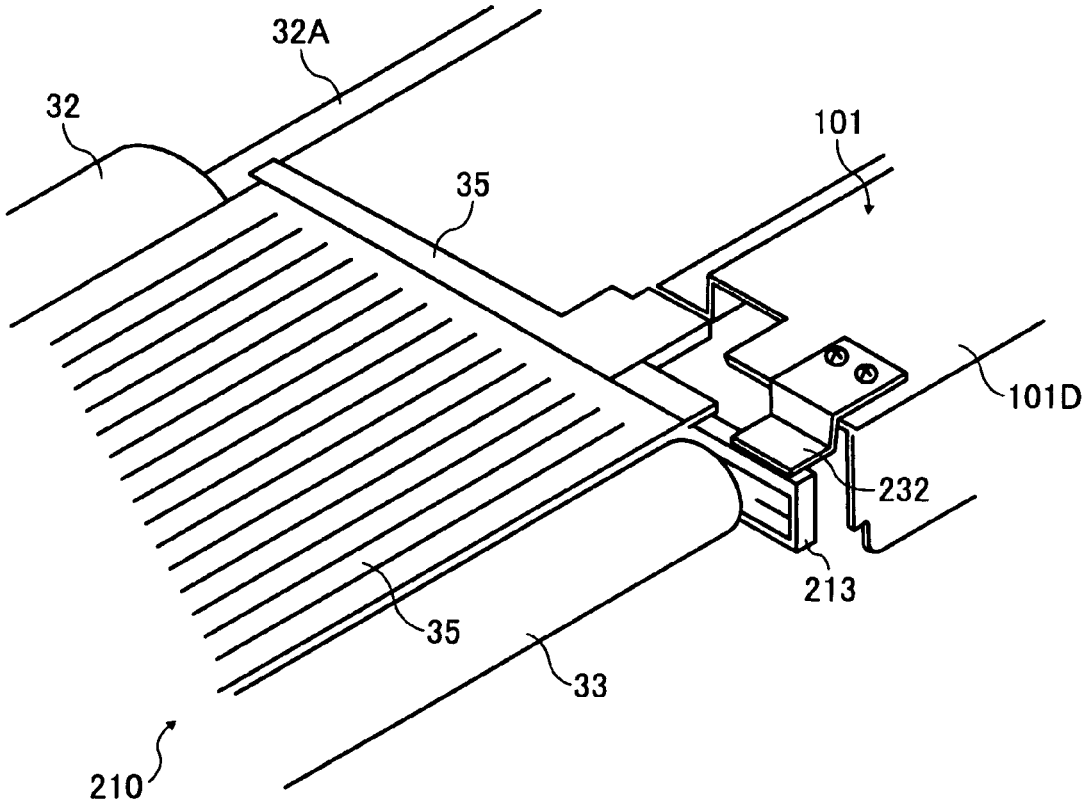
FIG. 15 is a perspective view of an exemplary adjuster of the frame shown in FIG. 12.

Referring to FIG. 15, the following describes an example of the adjuster. FIG. 15 is a perspective view of a portion of the belt unit 210 and a portion of the frame 101. As illustrated in FIG. 15, the frame 101 further includes a frame portion 101D and an adjuster 232. The frame portion 101D forms a part of the frame 101. The adjuster 232 is attached to the frame portion 101D and adjusts a position of the support 213 for supporting the tension roller 33 in the direction Z (depicted in FIG. 9). For example, the adjuster 232 presses down the support 213 to adjust the position of the support 213 in a vertical direction (and thereby also the position and/or orientation of the tension roller 33).

The adjuster 232 is attached to the frame 101. Namely, the adjuster 232 is separately provided from the belt unit 210. The adjuster 232 can be attached in a direction common to a direction in which the belt unit 210 is attached to the frame 101. Namely, the adjuster 232 is attached downward to the frame portion 101D of the frame 101.

The height (or relative vertical position) of the tension roller 33 is adjusted to a level at which the degree of parallelism of the tension roller 33 and the conveying roller 32 is in a desired range. After the height (or relative position) of the tension roller 33 is adjusted, the adjuster 232 can be fixed to the frame portion 101D with an adhesive or an engaging member.

As described above, the adjuster 232 adjusts the position of the support 213 for supporting at least one end of the tension roller 33 (serving as a driven roller) in an axial direction of the tension roller 33. The position (or height) of the at least one end of the tension roller 33 is adjusted to maintain parallelism of the tension roller 33 and the conveying roller 32. Thus, the conveying belt 31 (depicted in FIG. 12) may not be moved, or mounted on the frame 101, obliquely and thereby may stably convey a sheet P.

The adjuster 232 is attached not to the belt unit 210 but to the frame 101. The adjuster 232 is attached to the frame 101 in the direction common to the direction in which the belt unit 210 including the tension roller 33 and the conveying belt 31 is attached to the frame 101. Thus, even when the belt unit 210 is detached from the frame 101 for replacement of the conveying belt 31, the belt unit 210 may be properly attached again to the frame 101 easily.

Figure 16:
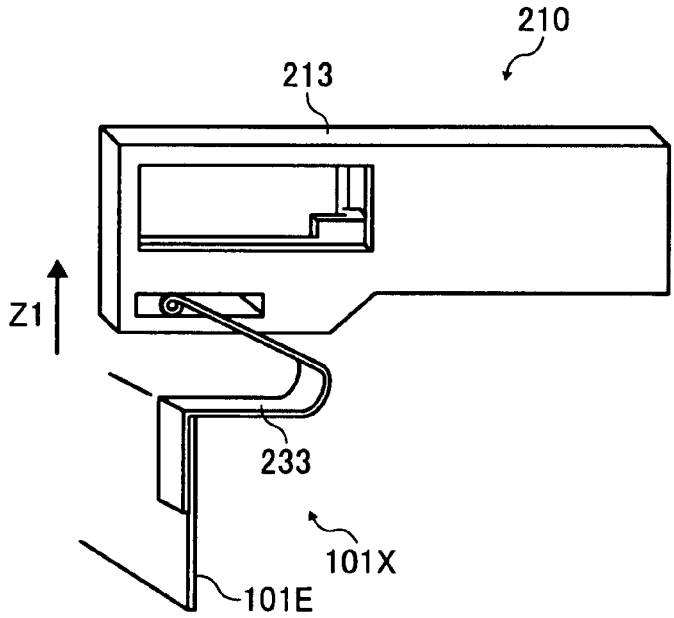
FIG. 16 is a perspective view of another exemplary adjuster of the frame shown in FIG. 12.

Referring to FIG. 16, the following describes another example of the adjuster. FIG. 16 is a perspective view of a portion of the belt unit 210 and a portion of a frame 101X. As illustrated in FIG. 16, the frame 101X includes a frame portion 110E and an adjuster 233 instead of the frame portion 101D and the adjuster 232 (depicted in FIG. 15). The other elements of the frame 101X are common to the frame 101 (depicted in FIG. 15). The frame portion 110E forms a part of the frame 101X. The adjuster 233 is attached to the frame portion 101E and adjusts the position of the support 213 for supporting the tension roller 33 (depicted in FIG. 15) in the direction Z (depicted in FIG. 9). For example, the adjuster 233 pushes up the support 213 in a direction Z1 to adjust the position (or height) of the support 213 for supporting the tension roller 33. The adjuster 233, also serving as a force applier for applying a force to the tension roller 33, includes a spring plate.

The adjuster 233 adjusts the position of the support 213 for supporting at least one end of the tension roller 33 (serving as a driven roller) in the axial direction of the tension roller 33. The position (or height) of the at least one end of the tension roller 33 is adjusted to maintain parallelism of the tension roller 33 and the conveying roller 32 (depicted in FIG. 15).

Thus, the conveying belt 31 (depicted in FIG. 12) may not be moved, or mounted on the frame 11X, obliquely, and thereby may stably convey a sheet P.

Figure 17:
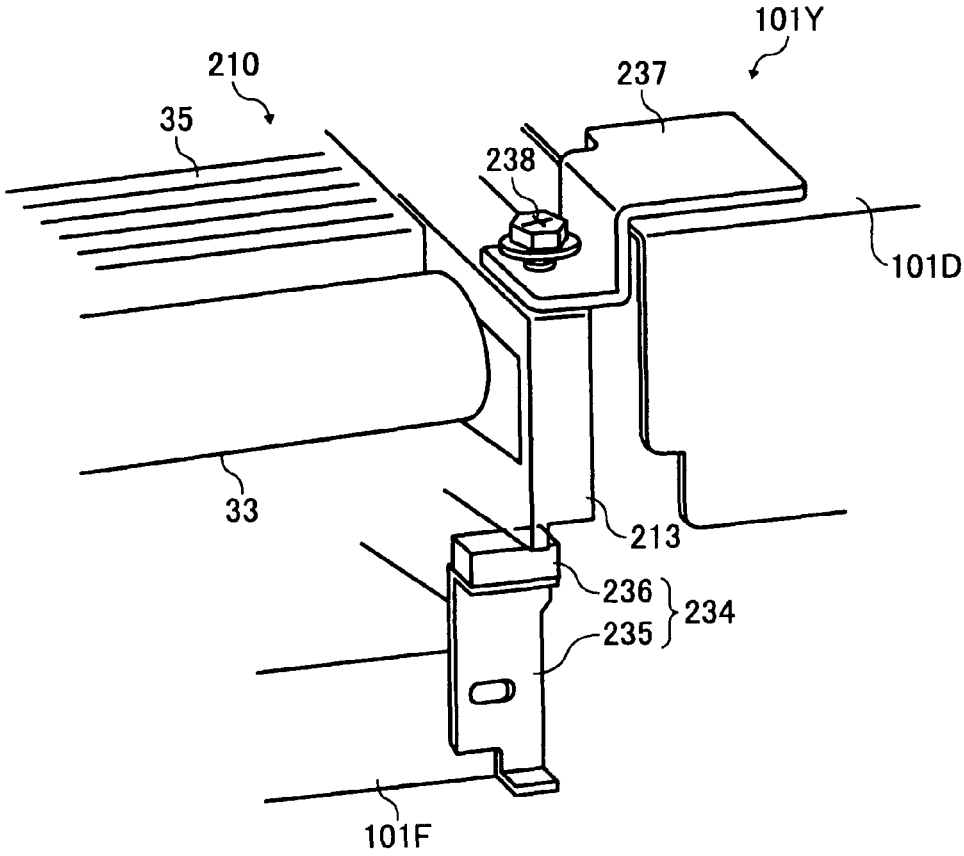
FIG. 17 is a perspective view of yet another exemplary adjuster of the frame shown in FIG. 12.

Referring to FIG. 17, the following describes yet another example of the adjuster. FIG. 17 is a perspective view of a portion of the belt unit 210 and a portion of a frame 110Y. As illustrated in FIG. 17, the frame 110Y includes a frame portion 101F and an adjuster 234 instead of the frame portion 110E and the adjuster 233 (depicted in FIG. 16). The frame 101Y further includes a regulating member 237 and a screw 238 instead of the adjuster 232 (depicted in FIG. 15). The adjuster 234 includes a fixing member 235 and an elastic member 236. The other elements of the frame 101Y are common to the frame 101 (depicted in FIG. 15).

The frame portion 101F forms a part of the frame 101Y. The adjuster 234 is attached to the frame portion 101F and adjusts the position of the support 213 for supporting the tension roller 33 in the direction Z (depicted in FIG. 9). The fixing member 235 can be fixed to the frame portion 101F with an engaging member (not shown), for example. The elastic member 236 is provided on a top surface of the fixing member 235. A resilience of the elastic member 236, serving as a force applier for applying a force to the tension roller 33, pushes up the support 213 to adjust the position (or height) of the support 213 for supporting the tension roller 33.

The regulating member 237 can be fixed to the frame portion 101D and a top surface of the support 213. For example, the screw 238 is provided on the regulating member 237. The regulating member 237 and the screw 238 regulate the support 213 at the top surface of the support 213.

The adjuster 234, the regulating member 237, and the screw 238 adjust the position of the support 213 for supporting at least one end of the tension roller 33 (serving as a driven roller) in the axial direction of the tension roller 33. The position (or height) of the at least one end of the tension roller 33 is adjusted to maintain parallelism of the tension roller 33 and the conveying roller 32 (depicted in FIG. 15). Thus, the conveying belt 31 (depicted in FIG. 12) may not be moved, or mounted on the frame 101Y, obliquely, and thereby may stably convey a sheet P.

Figure 18:
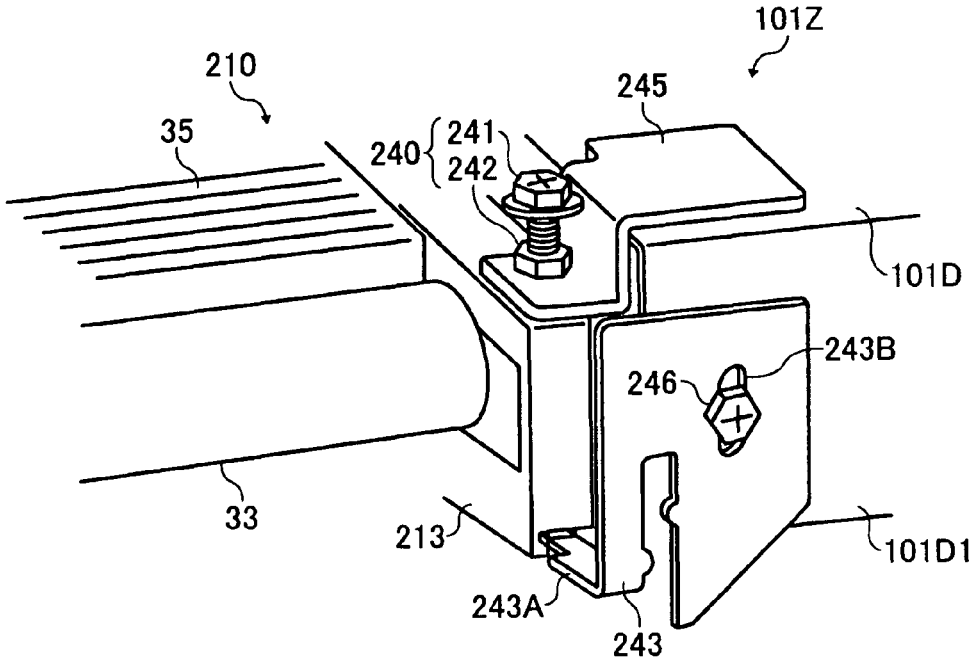
FIG. 18 is a perspective view of yet another exemplary adjuster of the frame shown in FIG. 12.

Referring to FIG. 18, the following describes yet another example of the adjuster. FIG. 18 is a perspective view of the belt unit 210 and a frame 101Z. As illustrated in FIG. 18, the frame 101Z includes an adjuster 240, a pressing member 243, a holder 245, and an engaging member 246 instead of the adjuster 232 (depicted in FIG. 15). The adjuster 240 includes a screw 241 and a nut 242. The pressing member 243 includes an engaging portion 243A and an elongate hole 243B. The frame portion 101D includes a side surface 101D1. The other elements of the frame 101Z are common to the frame 101 (depicted in FIG. 15).

The adjuster 240 is provided on the top surface of the support 213 for supporting the tension roller 33 to adjust the position of the support 213 to a desired position in the direction Z (depicted in FIG. 9). The pressing member 243 serves as an adjuster for adjusting the position of the support 213 or a force applier for applying a force to the tension roller 33. For example, the pressing member 243 contacts a bottom surface of the support 213 and presses the support 213 for supporting the tension roller 33 so as to maintain the support 213 at the adjusted position.

The holder 245 has a shape common to the adjuster 232 (depicted in FIG. 15) and is attached to the frame portion 101D. The screw 241 can be inserted in the holder 245 in a manner that a bottom head of the screw 241 contacts the support 213. The screw 241 is movable upward and downward. The nut 242 engages with the screw 241 to lock the screw 241. The bottom head of the screw 241 regulates the position of the top surface of the support 213.

The side surface 101D1 forms a side surface of the frame portion 101D. The engaging portion 243A contacts the bottom surface of the support 213. The engaging member 246 (e.g., a screw) engages with the elongate hole 243B provided in the pressing member 243. Thus, the pressing member 243 is secured to the side surface 101D1 with the engaging member 246. After the adjuster 240 adjusts the position of the support 213 to provide parallelism of the tension roller 33 and the conveying roller 32 (depicted in FIG. 15), the engaging portion 243A of the pressing member 243 contacts the bottom surface of the support 213 to maintain the adjusted position of the support 213.

The position (or height) of the tension roller 33 is adjusted with an adjustment jig. For example, a degree of parallelism of the tension roller 33 and the conveying roller 32 is calculated based on a relationship among four positions (i.e., two reference positions on the platen guide 35, depicted in FIG. 13, and upper end surfaces of the supports 212 and 213 for supporting the tension roller 33, depicted in FIG. 10). The position of the tension roller 33 is adjusted based on the calculated degree so that the degree of parallelism of the tension roller 33 and the conveying roller 32 after adjustment equals to a desired level. The nut 242 fixes the tension roller 33 at the desired level. Thus, an adjustment process is completed.

The adjuster 240, the holder 245, the pressing member 243, and the engaging member 246 adjust the position of the support 213 for supporting at least one end of the tension roller 33 (serving as a driven roller) in the axial direction of the tension roller 33. The position (or height) of the at least one end of the tension roller 33 is adjusted to maintain parallelism of the tension roller 33 and the conveying roller 32 (depicted in FIG. 15). Thus, the conveying belt 31 (depicted in FIG. 12) may not be moved, or mounted on the frame 101Z, obliquely, and thereby may stably convey a sheet P. Further, the position of the tension roller 33 may be adjusted with improved precision.

The image forming apparatus 1 (depicted in FIG. 1), in which the belt conveying device 300 (depicted in FIG. 12) according to the above-described exemplary embodiments is installed, forms an image by discharging liquid drops. However, the belt conveying device may be applied to an image forming apparatus for forming an image by an electrophotographic method. The belt conveying device can include a conveying belt (such as the conveying belt 31 depicted in FIG. 12) which attracts a sheet by an electric field action generated by an alternating current charging. However, the belt conveying device may include a conveying belt which attracts a sheet by air or by an electric field action generated by a direct current charging.

In the belt conveying device (such as the belt conveying device 300 depicted in FIG. 12) according to the above-described exemplary embodiments, the conveying belt having an endless belt shape (such as the conveying belt 31 depicted in FIG. 9) is looped over at least a driving roller (for example the conveying roller 32 depicted in FIG. 9) and a driven roller (for example the tension roller 33 depicted in FIG. 9). The platen guide (such as the platen guide 35 depicted in FIG. 9) causes the conveying belt to have a flat plane surface between the driving roller and the driven roller. The adjuster (for example the adjuster 232, 233, 234, or 240 depicted in FIG. 15, 16, 17, or 18, respectively) adjusts the position of the support (such as the support 213 depicted in FIG. 12) for supporting at least one end of the driven roller in an axial direction of the driven roller. Namely, the adjuster may adjust the position (or height) of the at least one end of the driven roller to maintain parallelism of the driving roller and the driven roller. Thus, the conveying belt may not be moved, or mounted on the frame (for example, the frame 101, 101X, 101Y, or 101Z depicted in FIG. 15, 16, 17, or 18, respectively), obliquely, and thereby may stably convey a sheet. Accordingly, the image forming apparatus, in which the belt conveying device is installed, may stably convey a sheet and may form an image having an improved quality.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2006-183888 filed on Jul. 3, 2006 in the Japan Patent Office, the entire contents of which are hereby incorporated herein by reference.

What is claimed is:

1. An image forming apparatus, comprising:

an image forming member configured to form an image on a sheet; and a belt conveying device configured to convey the sheet and including first and second rollers, a conveying belt having an endless belt-like shape and looped over at least the first and second rollers, a platen guide provided between the first and second rollers in a sheet conveyance direction and configured to guide the conveying belt to form a substantially flat plane surface, a support configured to support at least one end of the second roller, said one end being in an axial direction of the second roller, an adjuster configured to adjust a position of the support, and a frame configured to support the belt conveying device, wherein the adjuster adjusts the position of the support in a first direction perpendicular to the sheet conveyance direction, by applying a force vertically in the first direction to adjust the position of the support, the adjuster is attached downward in a second direction to the frame, the belt conveying device is attached to the frame in a third direction, and the first direction, second direction and third direction are respectively vertical and are parallel to each other, wherein the belt conveying device is disposed to be detached from the adjuster and frame vertically in the third direction, wherein the adjuster attached to the frame includes a plate-shaped holder attached to the frame and configured to hold the adjuster, a screw penetrating the holder, and a nut, the adjuster is provided above the support and the frame, and the adjuster presses down the support with the screw, and the screw is screwed down to the support to adjust a height of the support, wherein the adjuster further includes a force applier configured to apply a force to the second roller, and the force applier is provided below the support and contacts a bottom surface of the support to press up the support with a plate bias thereof, and wherein the adjuster and the force applier sandwich the support and press and hold the support vertically.

2. The image forming apparatus of claim 1, wherein the first roller includes a driving roller for driving the conveying belt and the second roller includes a driven roller for being driven by the driving roller via the conveying belt.

3. The image forming apparatus of claim 1, wherein the conveying belt attracts and conveys the sheet.

4. The image forming apparatus of claim 3, wherein the conveying belt attracts the sheet by air.

5. The image forming apparatus of claim 3, wherein the conveying belt attracts the sheet by an electric field action.

6. The image forming apparatus of claim 5, wherein the conveying belt is charged by a direct current electric field.

7. The image forming apparatus of claim 5, wherein the conveying belt is charged by an alternating current electric field.

8. The image forming apparatus of claim 1, wherein the image forming member discharges a liquid drop to form the image on the sheet.

9. The image forming apparatus of claim 1, wherein the holder holds the adjuster while the adjuster applies the force in the first direction to the top surface of the support.

10. The image forming apparatus of claim 1, wherein the holder has a first substantially horizontal portion attached to a complementary substantially horizontal portion of the frame, and the holder has a second substantially horizontal portion complementary to a top surface of the support.

11. The image forming apparatus of claim 1, wherein the support restricts movement of the second roller in an axial direction of the second roller.

12. The image forming apparatus of claim 1, wherein the force applier includes a single plate bent at a substantially right angle to have a first face secured to a vertical side surface of the frame, and a second face contacting the bottom surface of the support to press up the support with a plate bias.

13. A belt conveying device for conveying a sheet, comprising:

first and second rollers;

a conveying belt having an endless belt-like shape and looped over at least the first and second rollers;

a platen guide provided between the first and second rollers in a sheet conveyance direction and configured to guide the conveying belt to form a substantially flat plane surface;

a support configured to support at least one end of the second roller, said one end being in an axial direction of the second roller;

an adjuster configured to adjust a position of the support; and a frame configured to support the belt conveying device, wherein the adjuster adjusts the position of the support in a first direction perpendicular to the sheet conveyance direction, by applying a force vertically in the first direction to adjust the position of the support, the adjuster is attached downward in a second direction to the frame, the belt conveying device is attached to the frame in a third direction, and the first direction, second direction and third direction are respectively vertical and are parallel to each other, and wherein the belt conveying device is disposed to be detached from the adjuster and frame vertically in the third direction, wherein the adjuster attached to the frame includes a plate-shaped holder attached to the frame and configured to hold the adjuster, a screw penetrating the holder, and a nut, the adjuster is provided above the support and the frame, and the adjuster presses down the support with the screw, and the screw is screwed down to the support to adjust a height of the support, wherein the adjuster further includes a force applier configured to apply a force to the second roller, and the force applier is provided below the support and contacts a bottom surface of the support to press up the support with a plate bias thereof, and wherein the adjuster and the force applier sandwich the support and press and hold the support vertically.

14. The belt conveying device of claim 13, wherein the conveying belt attracts and conveys the sheet.

15. The belt conveying device of claim 14, wherein the conveying belt attracts the sheet by one of air and an electric field action.

16. The belt conveying device of claim 15, wherein the conveying belt is charged by one of direct and alternating current electric fields.

17. The belt conveying device of claim 13, wherein the force applier includes a single plate bent at a substantially right angle to have a first face secured to a vertical side surface of the frame, and a second face contacting the bottom surface of the support to press up the support with a plate bias.

* * * * *